US007963467B2

(12) United States Patent
Loesche

(10) Patent No.: US 7,963,467 B2
(45) Date of Patent: Jun. 21, 2011

(54) SAFETY SYSTEM FOR A ROLLER GRINDING MILL, AND METHOD FOR THE PRODUCTION OF CEMENT

(75) Inventor: Thomas Loesche, Ratingen (DE)

(73) Assignee: LOESCHE GmbH, Dusseldorf (DE)

( * ) Notice: Subject to any disclaimer, the term of this patent is extended or adjusted under 35 U.S.C. 154(b) by 830 days.

(21) Appl. No.: 10/571,547

(22) PCT Filed: Aug. 12, 2004

(86) PCT No.: PCT/EP2004/009069

§ 371 (c)(1),
(2), (4) Date: Jun. 26, 2008

(87) PCT Pub. No.: WO2005/028112

PCT Pub. Date: Mar. 31, 2005

(65) Prior Publication Data

US 2008/0245907 A1 Oct. 9, 2008

(30) Foreign Application Priority Data

Sep. 12, 2003 (DE) ..... 103 42 191
Sep. 18, 2003 (DE) ..... 103 43 218

(51) Int. Cl.
*B02C 19/00* (2006.01)

(52) U.S. Cl. ..... 241/23; 241/30; 241/119

(58) Field of Classification Search ..... 241/29, 241/30, 117–121, 23

See application file for complete search history.

(56) References Cited

U.S. PATENT DOCUMENTS

| | | | | |
|---|---|---|---|---|
| 1,480,767 | A * | 1/1924 | Kreutzberg | 241/61 |
| 2,475,814 | A * | 7/1949 | Bruchsaler | 241/41 |
| 4,192,469 | A * | 3/1980 | Jager | 241/121 |
| 5,244,157 | A * | 9/1993 | Brundiek | 241/36 |
| 5,971,302 | A * | 10/1999 | Doumet | 241/17 |
| 6,276,620 | B1 * | 8/2001 | Poeschl | 241/48 |
| 6,685,117 | B2 * | 2/2004 | Poeschl | 241/48 |

FOREIGN PATENT DOCUMENTS

| | | | |
|---|---|---|---|
| DE | 105 099 | C | 8/1899 |
| DE | 153 958 | C | 8/1904 |
| DE | 21 66 219 | A | 7/1973 |
| DE | 197 02 854 | A | 7/1998 |
| DE | 198 26 324 | C1 | 8/1999 |
| DE | 198 36 323 | A1 | 2/2000 |
| EP | 0406644 | A2 | 1/1991 |

(Continued)

OTHER PUBLICATIONS

Schneider, U., "Von der Auftragserteilung bis zum Betrieb der ersten QUADROPOL Rollenmuhle im Zementwerk Bosenberg," ZKG International (1999), vol. 52, No. 8, pp. 460-466.

(Continued)

*Primary Examiner* — Faye Francis
(74) *Attorney, Agent, or Firm* — Hoffman Warnick LLC

(57) ABSTRACT

The invention relates to a safety system ensuring availability of a milling or crushing plant with a roller grinding mill, which is provided in a combined plant, more particularly for the mill drying of cement raw material.

Figure 1:
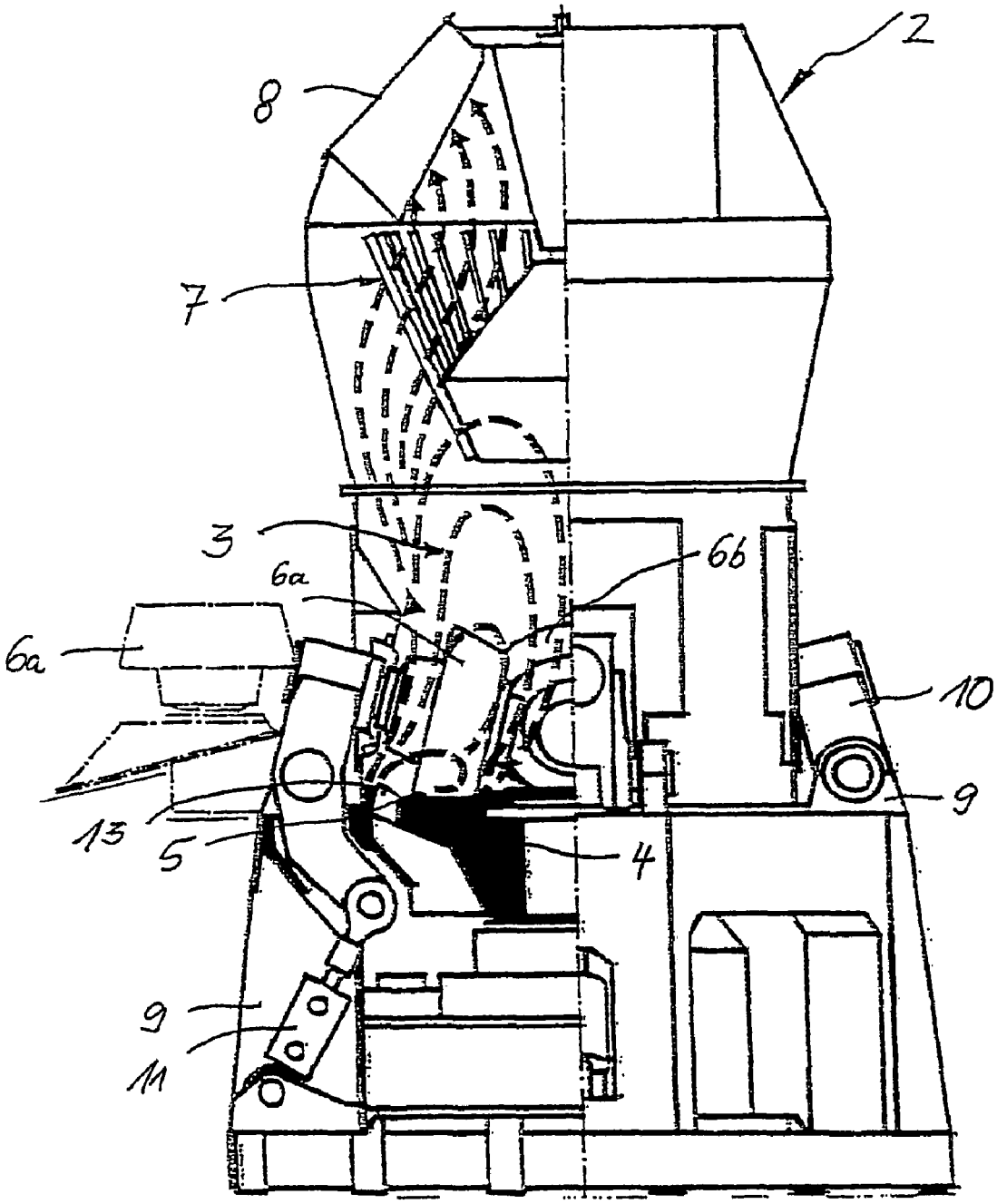

For bringing about an almost 100% redundancy, in particular six milling rollers are provided. The roller grinding mill is designed in such a way that 80% of the full milling capacity can be provided in four-roller operation.

5 Claims, 4 Drawing Sheets

FOREIGN PATENT DOCUMENTS

| | | | |
|---|---|---|---|
| GB | 1336119 | A | 11/1973 |
| JP | 59162940 | | 9/1984 |

OTHER PUBLICATIONS

Sakata, T. (u.a.), "One-kiln-one-mill system at Osaka Cement," ZKG (1983), vol. 36, No. 2, pp. 75-80.

Brundiek, H., "Die grobten Walzmuhlen der Welt fur die Herstellung von Zementrohmehl zu Beginn des 21 Jahrhunderts," ZKG International (2000), vol. 53, No. 4, pp. 177-185.

Brundiek, H., "The Roller Grinding Mill—Its History and Current Situation (Part 2)," Aufbereitungs-Technik (1989), vol. 30, No. 12, pp. 735-745.

PCT International Preliminary Examination Report on Patentability, International Application No. PCT/EP2004/009069, International Filing Date Aug. 12, 2004.

Kato, Notice of Allowance for Japanese Application No. JP2006525659 dated Feb. 23, 2010, 3 pages.

* cited by examiner

SAFETY SYSTEM FOR A ROLLER GRINDING MILL, AND METHOD FOR THE PRODUCTION OF CEMENT

The invention relates to a safety system for a roller grinding mill and to a method for the production of cement.

It is known to use roller mills for grinding the most varied materials. From the design and control standpoints and with respect to the energy consumption, environmental behaviour and overall economics, roller mills offer significant advantages.

In the cement industry roller mills are used both for the production of cement raw powder and for crushing clinker and coal. If raw material milling plants are operated in conjunction with rotary kilns and a calcining plant, the kiln waste gases from the heat exchanger and clinker cooler process can be used for milling drying and for the pneumatic conveying of the milled cement raw material or coal.

Methods for the production of cement in a combined system with a vertical air-swept Loesche-type roller mill for mill drying of a raw material mixture are described in DE 198 36 323 C2. DE-AS 23 61 060 discloses, in addition to mill drying of raw powder in an air-swept roller mill, a cooling milling of cement clinker in an air-swept roller mill downstream of a rotary kiln.

As a rule two, three and four-roller mills constructed according to a modular system are used. For the crushing of slags and mixed cements it is also advantageous to use modified Loesche system roller mills, which can be referred to as 2+2 roller mills or 3+3 roller mills. In the case of such 2+2 and 3+3 roller mills, use is made of roller pairs, comprising a precompacting roller, also called a S-roller (slave roller) and a crushing roller, also called a M-roller (master roller). Thus, in a 3+3 roller mill there are three crushing rollers and three precompacting rollers and in each case a precompacting roller is associated with a crushing roller. As a result of a preparation and a planned, uniform milling bed formation, a low vibration mill operation is achieved, so that higher specific milling or crushing forces are possible leading to an improved product quality (EP 0 406 644 B1).

In order to ensure the necessary operational safety and reliability of a cement plant in the case of a continuous rotary kiln operation through a corresponding mill efficiency, various safety concepts are known.

In a conventional safety concept two parallel roller mills are combined with a rotary kiln for raw powder processing in the case of high kiln efficiency levels. It is inter alia disadvantageous that the capital expenditure is much higher (approximately 20 to 40%) compared with a combination with a roller mill or a raw material crushing plant.

In principle, the high availability of the roller mill in the cement industry permits the most economic combination of a rotary kiln with a roller mill. In the case of four-roller mills with rollers supported individually in rocking levers according to the Loesche system, in conjunction with an adequately high volume flow it is possible to have a two-roller emergency operation in which approximately 55 to 60% of the full load production rate and a correspondingly reduced kiln efficiency are achieved. In the case of two or three-roller mills it is necessary to shut down the milling plants.

The object of the invention is to create a significantly improved safety system for a roller mill and also a method for cement production based on such roller mill safety system and to ensure an extremely high operational reliability of the cement plants with relatively low capital expenditure.

In connection with the roller mill safety system and with regards to cement production the objects are achieved by the features of the independent claims. Appropriate and advantageous developments are contained in the subclaims and the description relative to the drawings.

A fundamental idea of the invention is to so design a roller mill that it reaches the necessary mill production rate at approximately 80% of full load.

With regards to the use of a roller mill, e.g. for crushing a raw material mixture, this means that the cement raw material plant or the raw powder mill is designed in such a way that it ensures a twenty four hour operation of the rotary kiln with approximately 80% of full load.

According to the roller mill safety system according to the invention, a continuous availability of at least four milling rollers is ensured through the provision of more than four milling rollers providing approximately 80% of the full mill capacity in a four-roller operation.

There are preferably six milling rollers and approximately 80% of the full mill capacity is achieved in a four-roller operation, so that on the milling roller side an approximately 100% redundancy is ensured.

Appropriately each milling roller can be swung out from an operating position into a service position and the mill casing is sealed in such a way that four-roller operation is ensured when milling rollers are swung out.

Advantageously, the in particular six milling rollers are positioned in accordance with a per se known modular system. According to said modular system in each case one pedestal and one rocking lever or rocker arm are provided for supporting a milling roller, as well as a hydropneumatic spring suspension system for a milling roller pair, so that with six milling rollers a 3×2 roller mill is constructed.

This leads to the advantageous possibility of being able to further operate the roller mill in the case of breakdowns or damage to the milling rollers, rocking levers or spring suspension systems with four milling rollers following a brief stoppage and swinging out of one milling roller pair, so that 80% of the full mill capacity can be obtained. During this time the swung out milling rollers can be repaired or replaced.

The roller mill safety system according to the invention ensures in continuous manner a full capacity or efficiency of downstream devices, e.g. a rotary kiln, as a result of a corresponding roller mill efficiency.

Compared with the known safety concepts, the roller mill safety system according to the invention is extremely economic and reliable. The greatest economic advantages occur when using the inventive safety system in a cement plant operated in combined form. However, in principle, it can be used in all milling and crushing methods and also in a central milling plant.

The inventive method for the production of cement in a combined plant, in which in a cement raw material plant cement raw material undergoes in a roller mill using milling rollers rolling on a rotary milling surface and accompanied by the supply of waste gases from a heat exchanger or cooler process is subject to milling drying and following classifying and separation of the raw powder from the raw powder-waste gas mixture in a filter and/or cyclone is fed to a preheater and precalciner and a rotary kiln, a roller mill is provided which has more than four milling rollers for a milling roller-side, almost 100% redundancy. The roller mill is designed in such a way that 80% of the full mill capacity is provided by the four milling rollers.

In order to ensure an extremely high operational reliability during cement production, advantageously six milling rollers are associated with a 3×2 roller mill and the raw powder undergoes a milling drying. In accordance with the modular system the possibility exists that if a breakdown or damage occurs to rollers and rocking levers or to the hydropneumatic spring suspension and wearing parts of the rollers, the roller mill is briefly stopped and one roller pair is swung out. The roller mill can then be directly operated further with four milling rollers, whilst the swung out milling rollers are repaired, e.g. the roller shell is replaced.

The inventive safety system and a six-roller mill, particularly a 3×2 roller mill, can be used in all areas of use and milling/crushing processes, which require a clearly defined milling capacity of a roller mill for following processes, e.g. also in coal crushing for coal dust feeds and the like.

The invention is described in greater detail hereinafter relative to the attached highly diagrammatic drawings, wherein show:

FIG. 1A roller mill with a swung out milling roller.

FIG. 2A plan view of a milling pan with six milling rollers of a roller mill according to the inventive safety system.

FIG. 3A cement plant diagram for implementing the method according to the invention.

Figure 4:
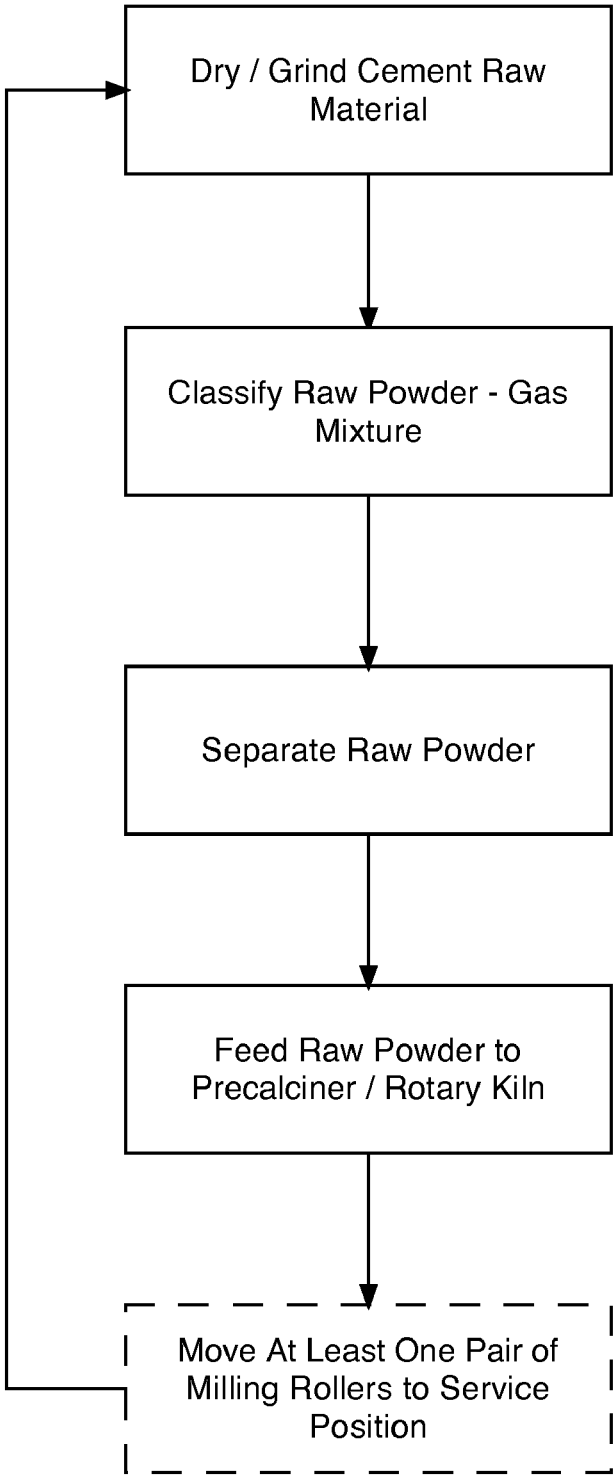

FIG. 4 A flow diagram of a method according to an embodiment of the invention.

FIG. 1 is a highly diagrammatic representation of a vertical air-swept, Loesche-type roller mill 2 with a milling chamber 3, a rotary milling pan 4 with a milling surface 5 and milling rollers 6*a* to 6*f* rolling thereon, a classifier 7 and a raw powder-waste gas outlet 8.

The milling rollers 6*a* to 6*f* are arranged in accordance with the modular system, which for each milling roller 6*a* to 6*f* has a pedestal 9 and a rocker arm or lever 10 for supporting a miller roller 6*a* to 6*f*, as well as a hydropneumatic spring loading system 11 for a roller pair 6*a*, 6*d*; 6*b*, 6*e*; 6*c*, 6*f*, so that a 3×2 roller mill is formed.

Through the provision of six milling rollers and the design of roller mill 2 in such a way that approximately 80% of the full mill capacity can be provided by four milling rollers, a safety system is brought about on the milling roller side, which ensures an almost 100% redundancy.

Figure 3:
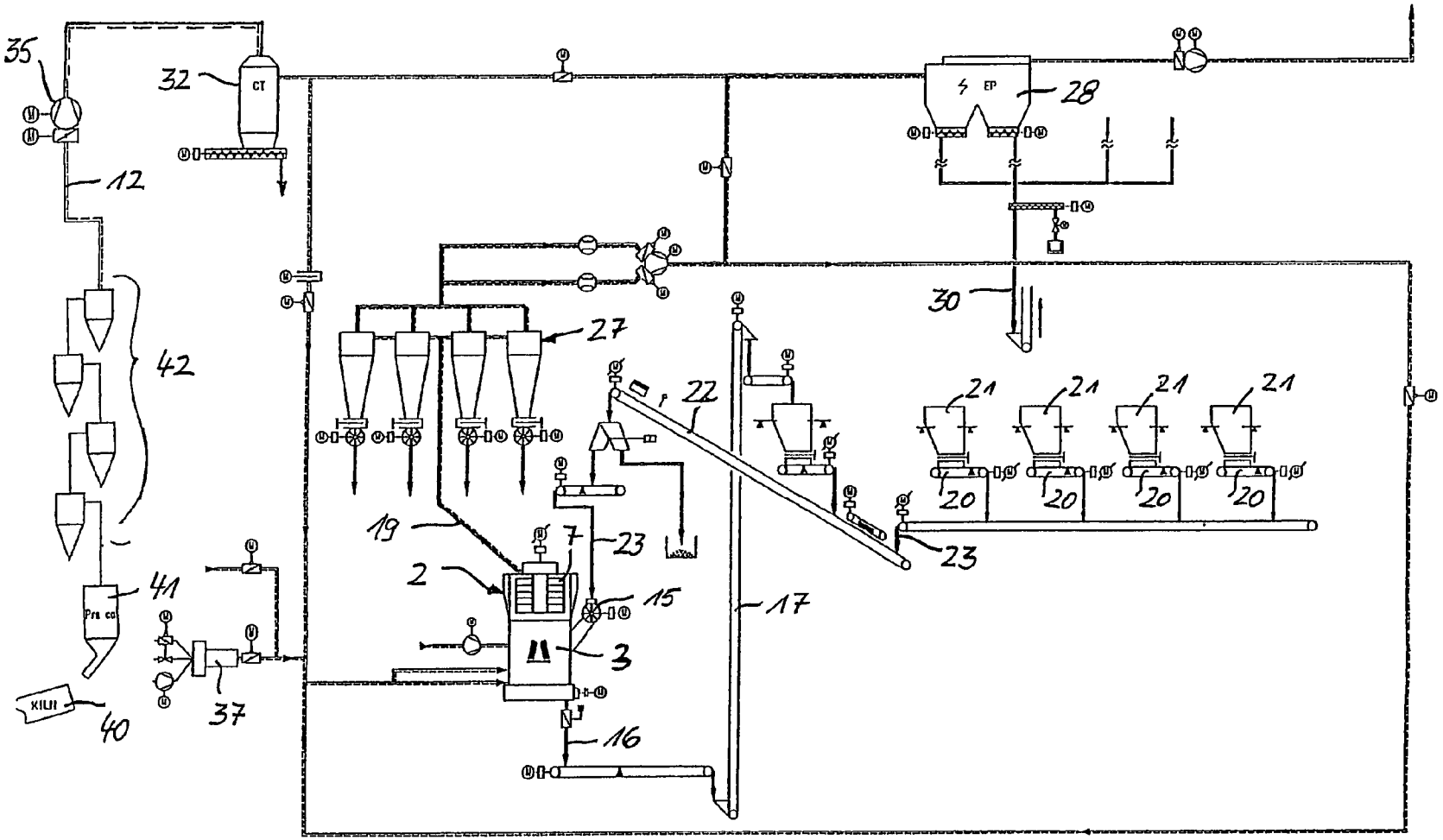

When using a roller mill 2 for the mill drying of cement raw material or a raw material mixture which can be fed with initial moisture levels of up to 23% without predrying can be fed to the roller mill 2, particularly through a not shown, central feed mechanism, use is made of a hot gas, e.g. waste gas 12 from a clinker cooler or a heat exchanger unit 42 and/or cooler 32, as a drying and carrier gas for the raw powder (cf. FIG. 3). The waste gas 12 from the heat exchanger unit 42 flows from a supply duct (not shown), via a guide vane ring 13 or nozzle ring into the milling chamber 3 (cf. FIG. 1) and conveys the raw powder milled by the milling rollers 6*a* to 6*f* into the classifier 7 and via the raw powder-waste gas outlet 8 to a filter 28 (cf. also FIG. 3).

A swung out milling roller 6*a* is shown in the dot-dash representation of FIG. 1. Through the pairwise association of the hydropneumatic spring suspension system 11 the facing milling roller 6*d* (cf. FIG. 2) is also swung out, so that a four-roller operation is maintained. In the service position of milling roller 6*a* shown in dot-dash line form in FIG. 1, the facing milling roller 6*d* of said milling roller pair not being shown, the swung out milling rollers can be repaired, whilst the milling process is performed with approximately 80% of the full mill capacity.

Figure 2:
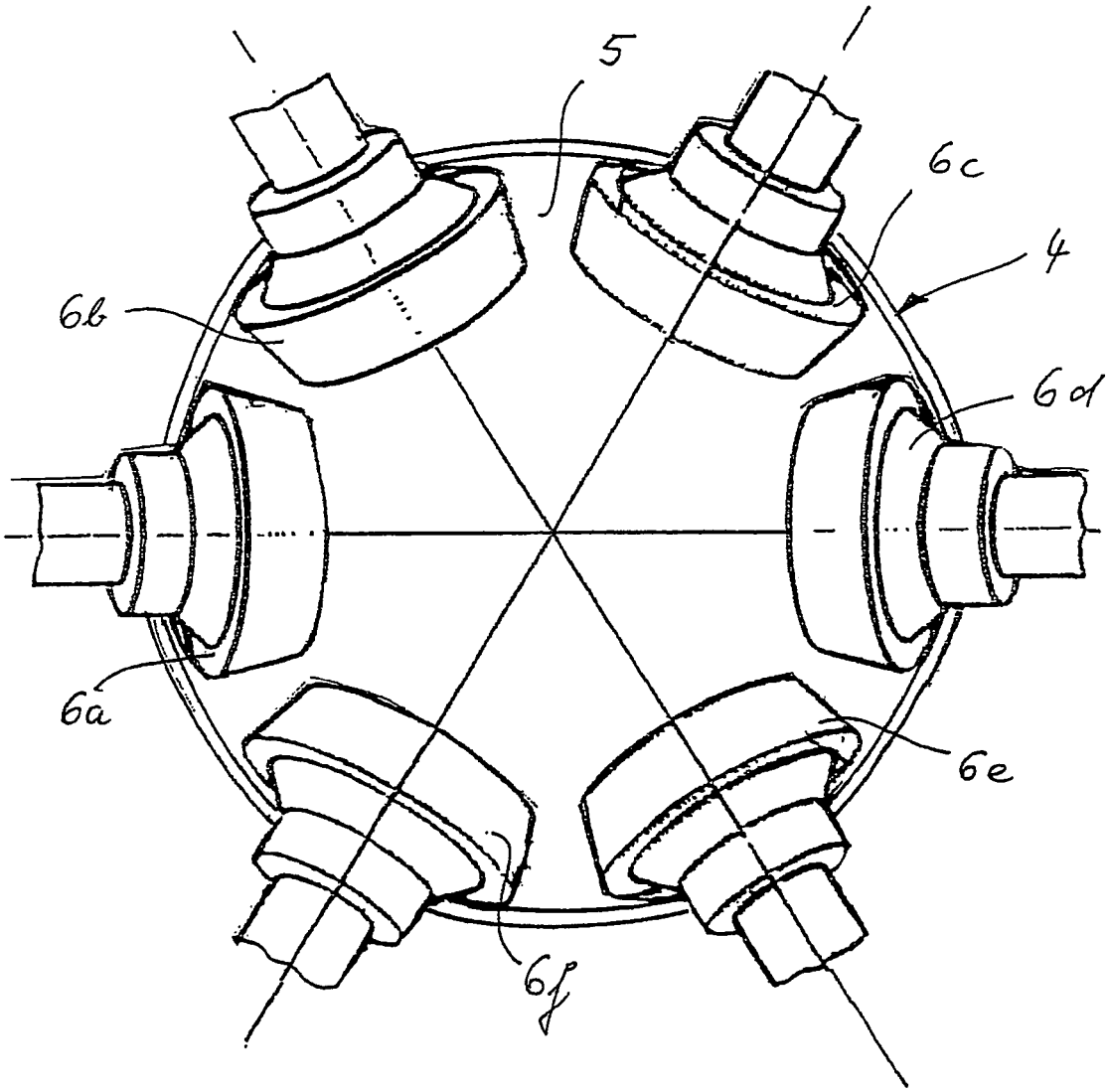

FIG. 2 shows in a plan view of a milling pan 4 with a milling surface 5 the safety system according to the invention for roller mills with more than four milling rollers. In this embodiment there are six milling rollers 6*a* to 6*f* and the milling pan 4 with milling surface 5 together with an adequately high volume flow permit a milling capacity amounting to approximately 80% of the full roller mill capacity if two milling rollers 6*a*, 6*d* or 6*b*, 6*e* or 6*c*, 6*f* of the six milling rollers 6*a* to 6*f* are swung out.

FIG. 3 shows in exemplified manner a cement plant diagram for performing the method according to the invention. The roller mill 2 is constructed according to FIGS. 1 and 2 and is used for crushing a raw material mixture 23 of individual components, which are supplied from hoppers 21 via weighing belts 20 to a belt feeder 22 and fed to the roller mill 2 via a lateral feed mechanism 15.

Coarse material 16 separated in roller mill 2 is at least partly admixed with the raw material mixture 23 by means of the feed mechanism 17 and supplied again to the roller mill 2.

For the mill drying of raw material mixture 23, use is made of the waste gases 12 from a heat exchange unit 42 which, as a function of the technology, is positioned upstream of a rotary kiln 40 with or without a precalciner 41. The heat exchanger waste gases 12 are fed downstream of heat exchanger blower 35 to the roller mill 2. As a function of the feed moisture level of the raw materia mixture 23, the waste gases 12 are passed directly to the roller mill 2 (not shown) or conditioned by a cooling tower 32 to the temperature required by the roller mill 2. If the heat level is inappropriate, it is possible to make good the missing heat quantity by cooler waste gas or with the aid of a hot gas producer 37.

A raw powder waste gas pipeline 19 leads from roller mill 2 to a cyclone unit 27 downstream of a filter 28 and the raw powder 30 obtained in filter 28 is passed directly or via a silo with a limited capacity (not shown) and heat exchanger unit 42 and precalciner 41 into the rotary kiln 40.

FIG. 3 illustrates the inventive safety system for ensuring the necessary mill efficiency with a view to a troublefree calcining process and with maximum utilization of rotary kiln 40. To this end the roller mill 2 has more than four milling rollers, particularly six milling rollers 6*a* to 6*f* according to FIG. 2.

The invention claimed is:

1. A method for the production of cement in a combined plant having a cement raw material plant, the method comprising:

drying a quantity of cement raw material using a supply of hot gas;

grinding the quantity of cement raw material in a roller grinding mill in the presence of the supply of hot gas to produce a raw powder-gas mixture, the roller grinding mill having:

a rotary milling surface; and six milling rollers arranged in facing pairs adjacent the rotary milling surface wherein each pair of the six milling rollers is operable to swing out from the rotary milling surface;

classifying the raw powder-gas mixture using a classifier;

separating the raw powder using at least one of a cyclone unit or a filter; and feeding the separated raw powder to at least one of a precalciner or a rotary kiln.

2. The method of claim 1, wherein the roller grinding mill further comprises: a pedestal and a rocking lever for supporting each milling roller; and a hydropneumatic spring suspension system for each pair of milling rollers.

3. The method of claim 2, further comprising:

moving at least one pair of milling rollers from an operating position to a service position; and operating the roller grinding mill using four milling rollers arranged in facing pairs.

4. The method of claim 3, wherein the operating the roller grinding mill using four milling rollers provides approximately 80% of the grinding capacity of the roller grinding mill when operated using six milling rollers.

5. The method of claim 1, wherein the drying and the grinding occur substantially simultaneously.

* * * * *